US006296309B1

(12) United States Patent
Kurtz

(10) Patent No.: US 6,296,309 B1
(45) Date of Patent: Oct. 2, 2001

(54) CHAIR CONSTRUCTION

(75) Inventor: Eric J. Kurtz, Rock Island, IL (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 09/325,933

(22) Filed: Jun. 4, 1999

(51) Int. Cl.[7] ..... A47C 3/00
(52) U.S. Cl. ..... 297/297; 297/300.2
(58) Field of Search ..... 297/411.44, 286, 297/285, 296, 297, 300.1, 300.2, 300.4, 411.2

(56) References Cited

U.S. PATENT DOCUMENTS 4,131,315 * 12/1978 Vogtherr .
4,703,974 * 11/1987 Brauning .
4,883,319 11/1989 Scott .
4,889,385 * 12/1989 Chadwick et al. .
5,102,196 * 4/1992 Kaneda et al. .
5,104,190 4/1992 Siegrist .
5,340,195 8/1994 Notta .
5,486,035 1/1996 Koepke et al. .
5,823,625 10/1998 Holmes .
5,826,940 * 10/1998 Hodgdon .
6,070,937 * 6/2000 Ginat .

* cited by examiner

*Primary Examiner*—Milton Nelson, Jr.
(74) *Attorney, Agent, or Firm*—Jones, Day, Reavis & Pogue

(57) ABSTRACT

A chair has a seat and reclinable back with a pair of armrests pivotably attached to the back. The back includes an outer shell and a mating inner shell. A bolt attaches each armrest to the outer shell and the inner shell is provided with sleeves for receiving the bolts and thereby securing the inner shell to the outer shell. By this arrangement, a single bolt provides for both the pivotable attachment of an armrest as well as for attaching the two mating shells together without any exposed hardware.

7 Claims, 3 Drawing Sheets

CHAIR CONSTRUCTION

BACKGROUND OF THE INVENTION

1. Field of the Invention

The present invention relates generally to the construction of a chair suitable for use in an office environment, and more particularly to a chair which is designed to have a reclinable back that is pivotably connected to an armrest assembly in a novel and highly economic manner.

2. Description of the Related Art

Seating articles, such as chairs, often are so constructed as to provide position adjustment of various parts of the chairs. This is particularly true of chairs used in office environments where office workers are frequently seated over long periods of time. In one such chair construction the chair back is designed to be reclinable relative to the seat allowing the user to selectively lean back in the chair if desired. An example of such a chair is disclosed in U.S. Pat. No. 5,486,035 issued Jan. 23, 1996 to Koepke et al., wherein the chair has a reclinable back, and the seat and back are interconnected by a stiff resiliently flexible transition connection connecting the seat rear portion and the back lower portion. The seat front portion is pivotably mounted on a support whereby reclining of the back raises the seat rear portion producing an occupant weight operated reclinable chair having a substantially uniform back reclining force requirement throughout the reclining range of motion.

In conventional office chair construction it is sometimes economical to manufacture the seat and back of the chair using molded plastic shells. In one such form of construction, the seat and back may each include two mating contoured shells, namely an upholstery shell and an outer shell. The upholstery shell in this construction is typically provided with suitable padding covered over by a layer of fabric or other similar upholstery material. The fabric layer, or the like, usually wraps over the peripheral edges of the shell and is fastened on the rear side of the shell. The outer shell which may or may not be similarly upholstered is then fastened to the back side of the upholstery shell thereby concealing the fastened edges of the fabric, lending an aesthetically pleasing finished appearance. A number of methods exist for fastening the shells together to create a finished chair. Such methods include the use of screws and snap fitting means cooperating between the two shells. However, the use of screws, for example, particularly if the screws are exposed to view is not as desirable aesthetically as a screwless appearance. Moreover, snap fitting means can make it difficult to take the chair apart once it is assembled, such as for reupholstering.

A chair having a reclinable back such as the above-mentioned Koepke et al. chair can be constructed using a variety of techniques, designs and appearances. In one particular form, such a chair may be made with armrests comprising tubular members that are pivotably attached to the reclinable back. The seat and back of such a chair may also be constructed using the afore-mentioned plastic molded shell technique including an upholstery shell and a mating outer shell. However, in such a chair construction, it is desirable to provide a pivotable attachment means for the armrest and back connection which is convenient to install and is reliable in use. It is further desirable to provide such an attachment means which not only serves to pivotably secure an armrest tube but also serves to provide a positive attachment of the two shells of the chair back without displaying the appearance of having exposed hardware.

SUMMARY OF THE INVENTION

The present invention improves over the prior art by providing a chair having a seat and reclinable back with a pair of armrests pivotably attached to the back. The back includes an outer shell and a mating inner shell. A bolt attaches each armrest to the outer shell and the inner shell is provided with sleeves for receiving the bolts and thereby securing the inner shell to the outer shell. By this arrangement, a single bolt provides for both the pivotable attachment of an armrest as well as for attaching the two mating shells together without any exposed hardware.

BRIEF DESCRIPTION OF THE DRAWINGS

The present invention will be better understood upon a reading of the following detailed description taken in conjunction with the accompanying drawings wherein.

DETAILED DESCRIPTION OF THE PREFERRED EMBODIMENT

Figure 1:
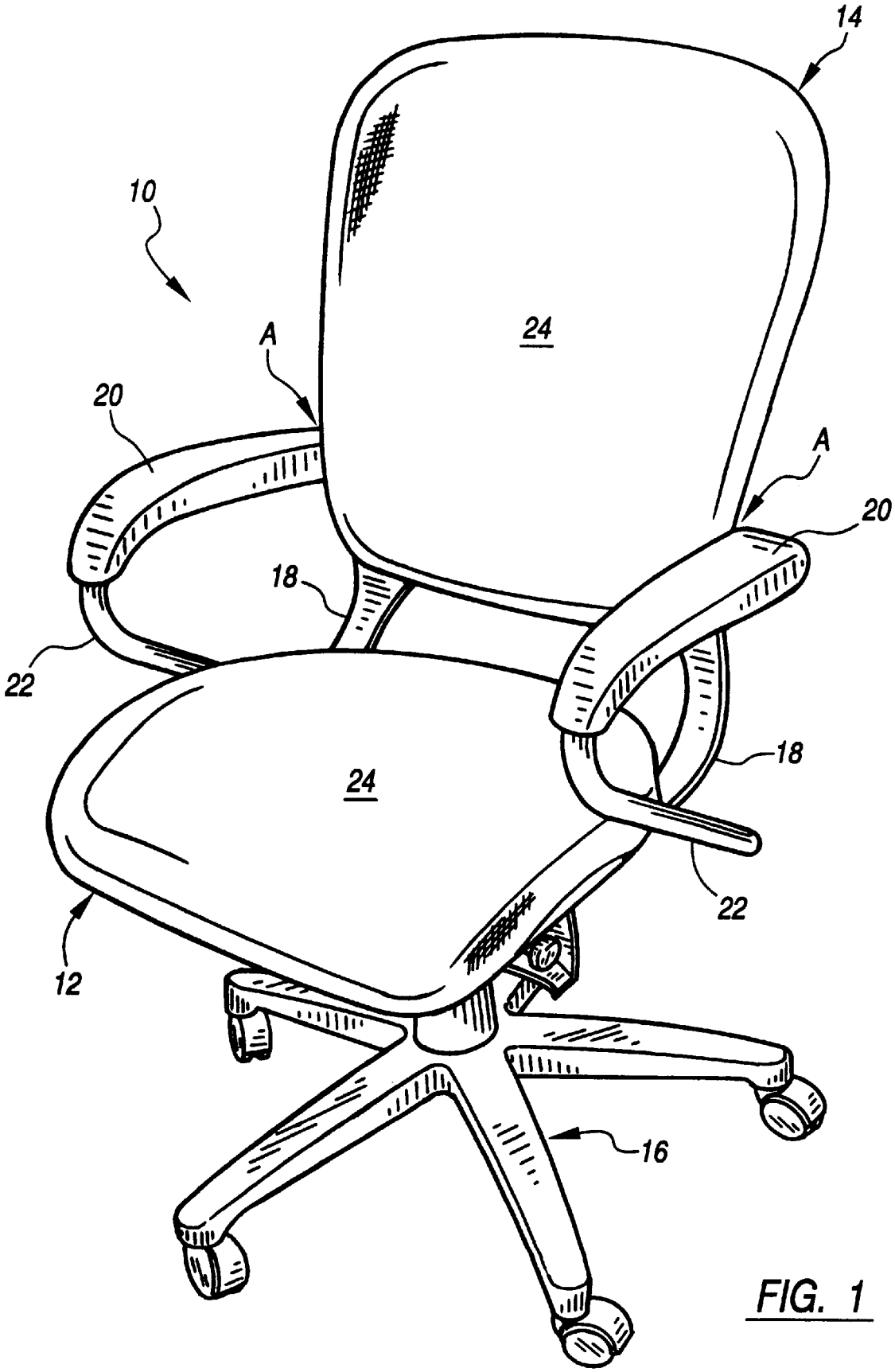
FIG. 1 is a perspective view of a chair of suitable construction for practicing the principles of the invention.

Referring now to the drawings, and initially to FIG. 1, a chair of a type suitable for practicing the principles of the invention is designated generally by the reference numeral 10. The chair 10 includes as its principal components a seat 12 and back 14 supported on a suitable base 16. The particular chair 10 illustrated is of a type having an operation and function as described in the afore-mentioned Koepke et al. U.S. Pat. No. 5,486,035, wherein the chair 10 has a reclinable back 14 and the seat 12 and back 14 are interconnected by a pair of stiff resiliently flexible members 18 connecting the seat 12 rear portion and the back 14 lower portion. The seat 12 front portion is pivotably mounted on a support (not shown) whereby reclining of the back 14 raises the seat 12 rear portion producing an occupant weight operating reclinable chair having a substantially uniform back 14 reclining force requirement throughout the reclining range of motion. The chair includes armrests 20 supported by tubular members 22. In order for the chair 10 to function properly, the armrests 20 are pivotably connected at points A to the chair back 14. The seat 12 and back 14 are shown as being upholstered with a suitable fabric 24.

Figure 2:
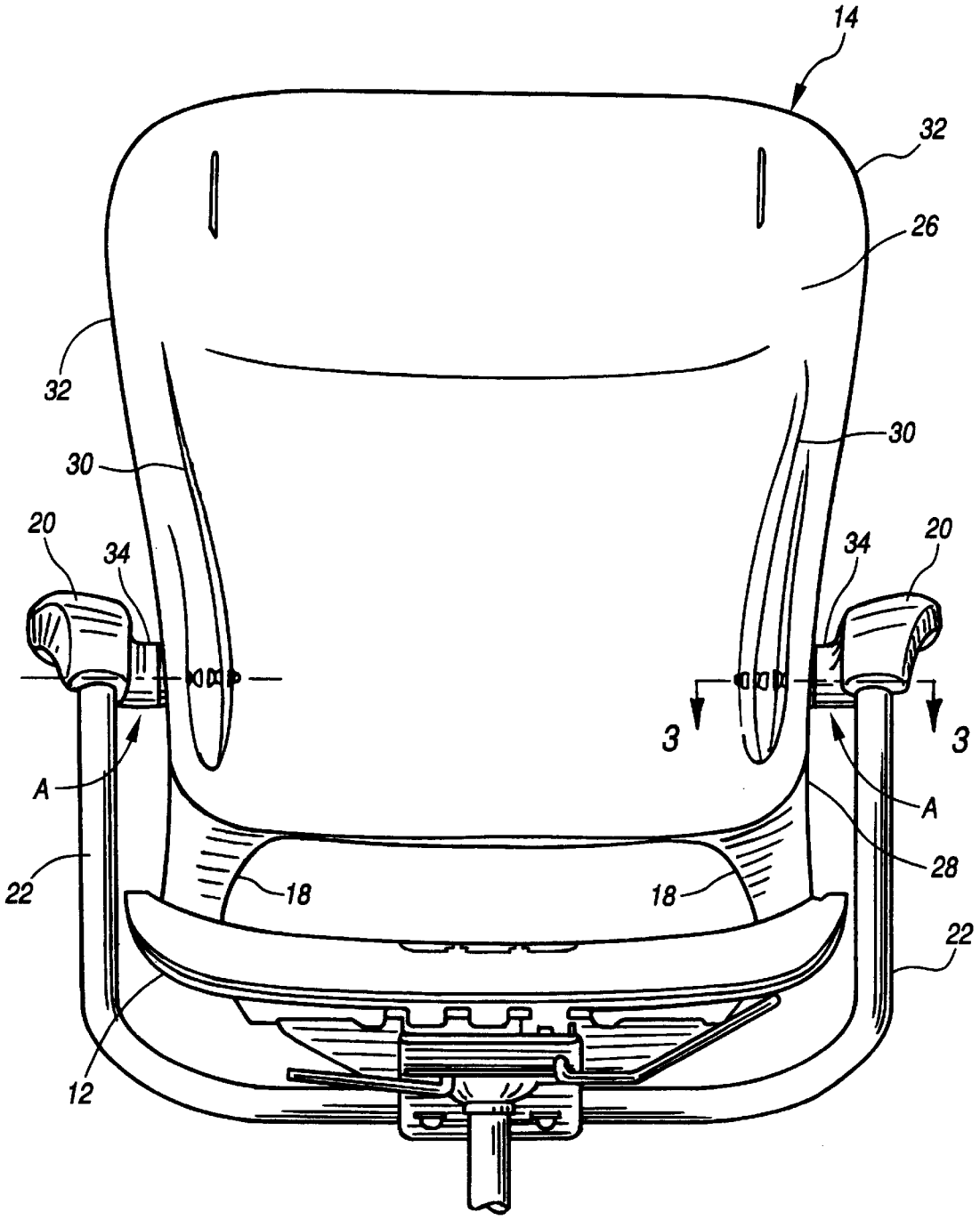
FIG. 2 is a partial front elevational view of the chair shown in FIG. 1.

FIG. 2 shows a view of the chair 10 without the fabric 24 upholstery. In this view, the back 14 can be seen to include an inner upholstery shell 26 and an outer shell 28 only a portion of which can be seen. The outer shell 28 mates with the inner shell 26 and basically has a peripheral shape similar to that of the inner shell 26. Thus, when the inner shell 26 is upholstered, fabric 24 wrapped around the edges of the inner shell 26 is concealed by the outer shell 28 when the two shells 26, 28 are assembled together. Both shells 26 and 28 may be molded of a suitable plastic, such as NYLON. The members 18 as shown in FIG. 1 may be integrally formed with the main body of the outer shell 28. The inner shell 26 is preferably formed with integrally molded reinforcing ribs 30 proximate side edges 32 thereof Further, the outer shell 28 includes projecting portions 34 at the points A of attachment of the armrests 20 as will be described in detail hereinafter.

Figure 3:
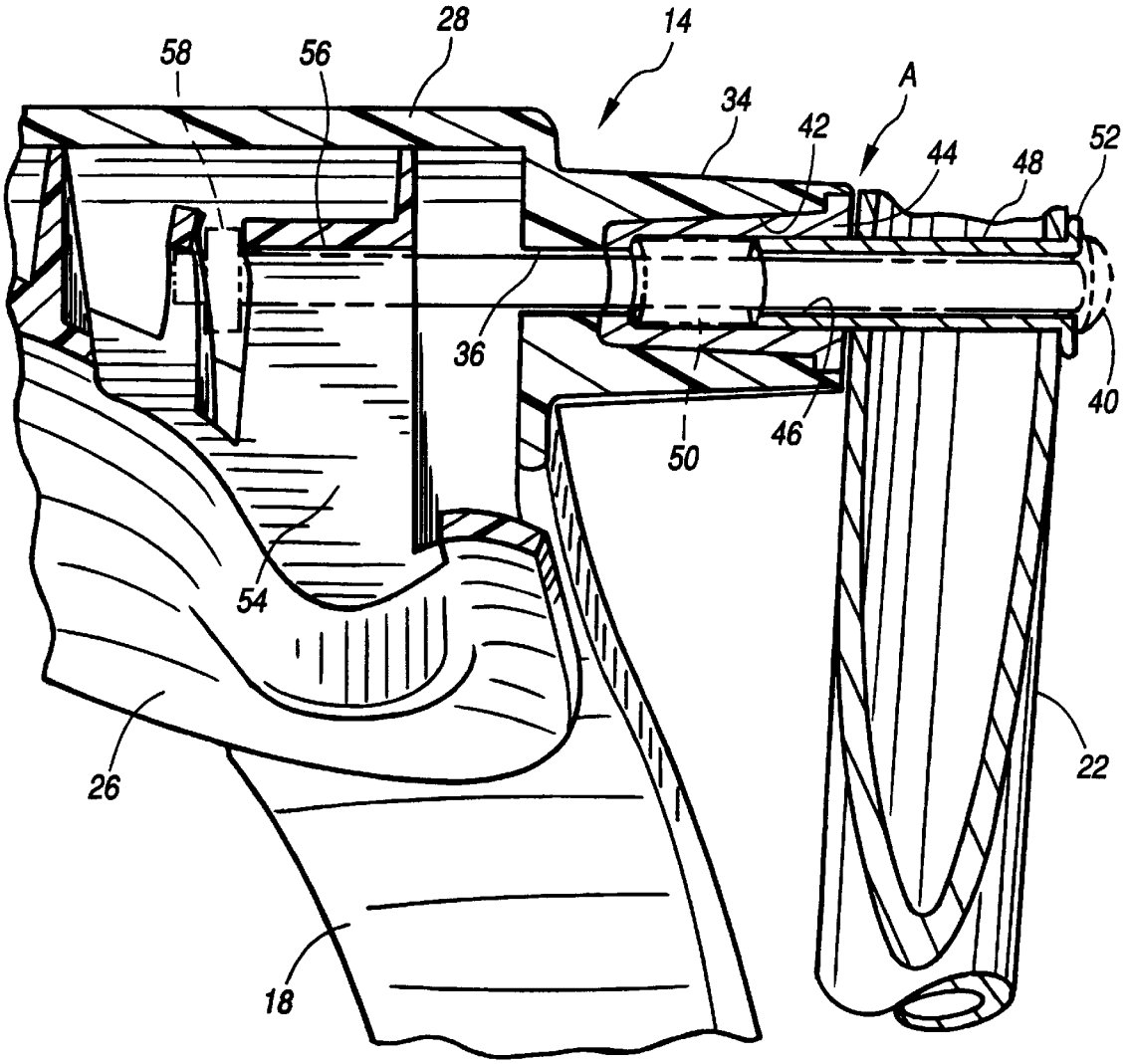
FIG. 3 is a partial cross-sectional view of the armrest attachment assembly as taken along the line 3—3 of FIG. 2.

Turning now to FIG. 3, a cross-sectional portion of the back 14 at an attachment point A of an armrest tube 22 is illustrated in detail. Each projecting portion 34 of the outer shell 28 is provided with a through bore 36 which is dimensioned to slidingly receive a bolt 40. A counterbore 42 receives a plug 44 having a stepped bore 46 which slidingly receives an arm bushing 48 and bushing cap 50 through which the bolt 40 passes. Each arm bushing 48 extends sufficiently outwardly of the projecting portion as to pivotably support a tubular member 22 of an armrest 20. A head 52 on each arm bushing 48 provides a seat for the bolt 40.

In accordance with the invention, the inner shell 26 is provided with an integrally molded projecting portion 54 defining a sleeve 56 through which the bolt 40 passes. A suitable nut 58 threadedly receives the bolt 40 and securely fastens the arm bushing 48 , the bushing cap 50, and the plug 44 within the counterbore 42 when the bolt 40 is tightened. Preferably, the plug 44 is formed from a harder material than that of the outer shell 28 , such as acetyl.

It can now be appreciated that a chair 10 constructed according to the invention having an armrest 20 pivot as just described offers considerable advantages in terms of reliability and manufacturing economies over chairs of known construction where inner and outer shells comprise the chair back. With a single bolt 40, an armrest 20 pivot A is provided which is both functional and reliable. Further, the bolt 40 also serves the additional function of securing together the inner and outer shells 26, 28 in a convenient and cost effective manner.

While the invention has been described in connection with a preferred embodiment thereof, it will be apparent to those skilled in the art that many changes and modifications may be made without departing from the true spirit and scope of the invention. Accordingly, it is intended by the appended claims to cover all such changes and modifications as come with the spirit and scope of the invention.

What is claimed is:

1. A chair comprising:

a seat and back, the back being reclinable relative to the seat;

a pair of armrests each pivotably attached to the back;

the back including an outer shell and a mating inner shell;

a bolt for attaching each armrest to the outer shell; and means provided on said inner shell for cooperating with said bolt to secure the inner shell to the outer shell;

wherein each bolt serves the purpose of securing the inner and outer shells together and also provides a pivotable means for attaching an armrest to the chair back.

2. The chair of claim 1 wherein said outer shell includes an extension portion having a bore for receiving a bolt.

3. The chair of claim 2 wherein the extension portion includes a counterbore for receiving a plug.

4. The chair of claim 3 wherein the counterbore received a bushing which in turn receives the bolt.

5. The chair of claim 2 wherein said inner shell includes a sleeve for receiving the bolt.

6. The chair of claim 5 wherein the inner and outer shell are secured together in mating relationship when said bolt is received by said bore and said sleeve.

7. The chair of claim 2 wherein the bolt secures an armrest tube to the outer shell.

* * * * *